US006868783B2

(12) United States Patent
Dufour et al.

(10) Patent No.: US 6,868,783 B2
(45) Date of Patent: Mar. 22, 2005

(54) PRINTING PRESS WITH MULTIPLE-IMAGE-CARRYING CYLINDER

(75) Inventors: Charles Henry Dufour, Durham, NH (US); John Sheridan Richards, Barrington, NH (US)

(73) Assignee: Goss International Americas, Inc., Dover, NH (US)

( * ) Notice: Subject to any disclaimer, the term of this patent is extended or adjusted under 35 U.S.C. 154(b) by 0 days.

(21) Appl. No.: 09/948,232

(22) Filed: Sep. 7, 2001

(65) Prior Publication Data

US 2003/0047092 A1 Mar. 13, 2003

(51) Int. Cl.[7] ..... B41F 13/12; B41F 13/14

(52) U.S. Cl. ..... 101/248; 101/375

(58) Field of Search ..... 101/248, 375, 101/376, 378, 485, 486, 481

(56) References Cited

U.S. PATENT DOCUMENTS

| | | | | | |
|---|---|---|---|---|---|
| 664,584 | A | * | 12/1900 | Roesen | 101/249 |
| 4,207,815 | A | * | 6/1980 | Watanabe | 101/248 |
| 5,383,393 | A | | 1/1995 | Ueda et al. | 101/220 |
| 6,553,908 | B1 | * | 4/2003 | Richards et al. | 101/248 |

FOREIGN PATENT DOCUMENTS

| | | | | | |
|---|---|---|---|---|---|
| DE | 10135506 | | 2/2002 | | |
| EP | 510744 | A1 | * | 10/1992 | B41F/27/10 |
| JP | 58151252 | A | * | 9/1983 | B41F/13/12 |
| JP | 03140245 | A | * | 6/1991 | B41F/13/12 |
| JP | 07241976 | A | * | 9/1995 | B41F/13/16 |
| JP | 10058642 | A | * | 3/1998 | B41F/13/11 |
| JP | 11314344 | A | * | 11/1999 | B41F/13/12 |
| JP | 2000954 | | | 1/2000 | |

OTHER PUBLICATIONS

English translation of Japanese patent JP 58–151252 to Okamura.*

English translation of Japanese patent JP 03–140245 to Hamaoka.*

Machine translation of JP 07–241976 from Japanese Patent Office website.*

* cited by examiner

*Primary Examiner*—Daniel J. Colilla
(74) *Attorney, Agent, or Firm*—Davidson, Davidson & Kappel, LLC

(57) ABSTRACT

A multiple-image-carrying cylinder has a cylinder section having at least part of a first image to be printed, a shell axially movable with respect to the cylinder section, the shell having at least part of a second image to be printed, and a ring located between the shell and the cylinder section and axially movable with respect to the shell and the cylinder section, the ring capable of having another part of the first image when connected to the cylinder section and capable of having another part of the second image when connected to the shell.

19 Claims, 5 Drawing Sheets

PRINTING PRESS WITH MULTIPLE-IMAGE-CARRYING CYLINDER

BACKGROUND OF THE INVENTION

1. Field of the Invention

The present invention relates generally to printing presses and other imaging devices and more particularly to an image-carrying cylinder.

2. Background Information

In a web offset lithographic printing press, a printing plate for an image to be printed is inked, and the image is then transferred to a blanket, which transfers the image to a continuous web of material. The printing press typically has four printing units, each for printing one of four colors on the web. As the web passes by the blanket cylinders of the printing units, it becomes moist, which can lead to an expansion of the web. The expansion of the web in the axial direction of the printing cylinders is known as web fanout. If fanout occurs, the print or images on the web thus expand slightly as the web passes each printing unit. The second and further printing units need to be properly registered with respect to the web images or print in an axial direction of the cylinders, so that, for example, a second color is applied by the second print unit directly over an image already printed by the first printing unit.

For some printing applications, multi-plate plate cylinders carrying a plurality of images across the width of the cylinder are used. These plate cylinders have a plurality of axially-spaced printing plates. For proper register of each printing plate and to correct web fanout, the plates may be movable independently of one another in an axial direction.

U.S. Pat. No. 4,207,815 purports to disclose a two-plate plate cylinder. One plate fits on a large diameter portion and another plate fits on a tube rotatable and axially movable with respect to the large diameter portion. The tube is fastened to a stepped shaft. Helical gearing is provided to set the axial and circumferential register of the plates.

U.S. Pat. No. 5,383,393 purports to disclose a multicolor lithographic rotary press comprising a plurality of printing sections arranged along a traveling line of a paper web, a plurality of register adjusting means, a paper stretching means, and a plurality of width adjusting means. Each of the printing sections further includes at least one divided plate cylinder, each divided section of which is independently moved in the axial direction and/or circumferential direction. The device of the '393 patent further discloses a register adjusting means mechanically connected to each of the divided plate cylinders in the printing sections, and includes an adjusting mechanism for actuating the divided sections in response to the control unit connected to a sensor for detecting the lines and images printed on the paper web by each of the printing sections.

BRIEF SUMMARY OF THE INVENTION

Commonly-owned U.S. Ser. No. 09/627,639 entitled "Multi-Plate Plate Cylinder for a Printing Press", which is hereby incorporated by reference herein, discloses a multi-plate plate cylinder having independently registerable shells. Commonly-owned U.S. Ser. No. 09/675,494 entitled "Web Fanout Control System", which is hereby incorporated by reference herein, discloses a web fanout control system for a printing press having multiple images carrying by the plate cylinder.

An object of the present invention is to provide a multiple-image-carrying cylinder and printing press that can accommodate variable image and web format sizes, i.e., different image and web widths. An alternate or additional object of the present invention is to permit web fanout control and proper register for such a printing press.

The present invention provides a multiple-image-carrying cylinder having a cylinder section having at least part of a first image to be printed. A shell is axially movable with respect to the cylinder section, the shell having at least part of a second image to be printed. A ring located between the shell and the cylinder section and is axially movable with respect to the shell and the cylinder section, the ring capable of having another part of the first image when connected to the cylinder section and capable of having another part of the second image when connected to the shell.

"Ring" and "shell" as defined herein are simply any type of structure having at least a partially curved outer surface.

By having the ring move between the cylinder section and the shell, various width images can be accommodated by the cylinder, while still permitting web fanout control and proper register.

A controller can set the shell as a function of a web width.

If the first image, for example, is narrow enough to fit entirely on the cylinder section, the ring is moved against the shell. The second image next to the first image thus is located on the outer surface of both the ring and the shell. The ring and shell can then move together axially to provide proper web fanout control.

If a new wider image is desired to replace the narrow first image, the ring is moved against the cylinder section and the wider image is located on both the cylinder section and the ring. A new image alongside the wider image is located entirely on the shell. The cylinder section and the ring then remain together and the shell can move to provide web fanout control and spacing between the two images.

Additional rings, axially movable with respect to the ring, shell and cylinder section, can be provided between the shell and the cylinder section to provide for even more formats.

Preferably, the cylinder section is axially stationary.

An additional shell maybe provided opposite the shell on another side of the cylinder section, as is an additional ring.

In a preferred embodiment, at least six images are carried by the cylinder section, the shell and the ring. Thus a six-image-wide press with the capability to support variable formats and to provide web fanout control is provided.

Preferably, the cylinder is a plate cylinder for carrying at least two flat printing plates. The cylinder section, shell and ring then all provided with axially-extending gaps having lock-up mechanisms. The lock-up mechanisms can be controlled for example by hydraulic pressure, and may be similar for example to those disclosed in U.S. Pat. No. 5,284,093 to Guaraldi et al., which is hereby incorporated by reference herein.

The axial movement of the shell and ring may be controlled by a mechanical actuator or a hydraulic actuator. The mechanical actuator for example may include a motor and lateral drive gear for the shell and a lateral drive gear for the ring. A throwoff gear connects the shell drive gear and the ring drive gear. If the throwoff gear is engaged, the ring moves with the shell and if the throwoff gear is disengaged, the ring remains with the cylinder section.

With the gear thrown off, manual adjustment of the ring is also possible.

Preferably, the shell and the ring have outer surfaces that define approximate half circles, with matching other half circles completing the full outer surface, for a two-around press. However, fully circular shells and rings for one-around presses are possible.

The shell and ring may be attached by dovetail joints to a cylinder body to permit axial movement, but to limit other movements. The cylinder body for example may have a dovetail slot and dovetails of the shells and rings fit into the slot. The dovetails can be smaller than the slot so that a clearance in the slot results, permitting easy axial movement. A sliding wedge can be used to occupy the clearance to fix the dovetails in place during operation. When axial movement is desired, the sliding wedge can be moved so that the clearance again results.

The present invention also provides a method for permitting variable width images on a cylinder comprising the steps of:

providing a first image to be printed to a first cylinder section;

providing a second image to be printed on a same material as the first image to both a second cylinder section and a third cylinder section connected to the second cylinder section, the second and third cylinder sections being axially movable with respect to the first cylinder section;

removing the first and second images; and providing a third image wider than the first image to both the first cylinder section and the second cylinder section and a fourth image to the third cylinder section, the first and second cylinder sections being connected and axially movable with respect to the third cylinder section.

Preferably, the images are located on flat printing plates, and the cylinder sections all have lock-up mechanisms. However, sleeve-shaped printing plates or direct imaging of the cylinder are also possible.

BRIEF DESCRIPTION OF THE DRAWINGS

Exemplary embodiments of the present invention are described below by reference to the following drawings, in which.

DETAILED DESCRIPTION

Figure 1:
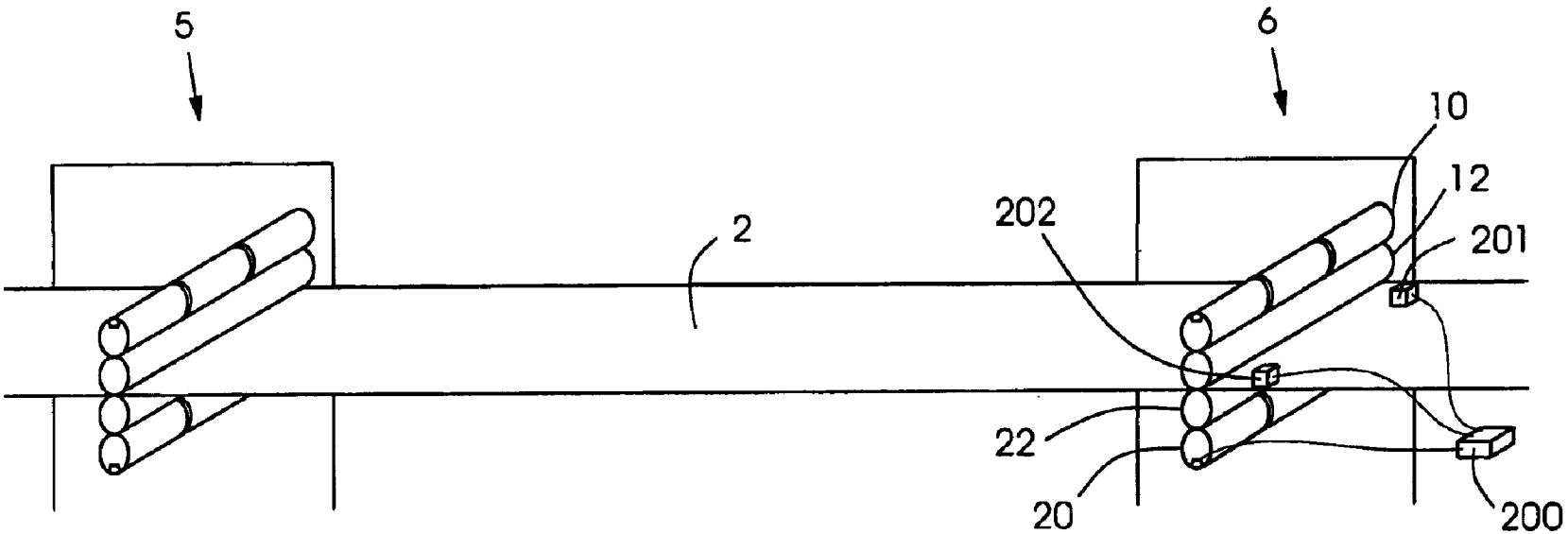
FIG. 1 shows schematically and in partial detail a preferred offset lithographic web printing press printing press according to the present invention.

FIG. 1 shows an exemplary offset lithographic web printing press with a first printing unit 5 and a second printing unit 6, although typically four such units are provided for a four-color press. Printing unit 6 has a first plate cylinder 10, a first blanket cylinder 12, a second plate cylinder 20 and a second blanket cylinder 22.

A web 2 is printed with side-by-side images, for example six wide, in a first color in first printing unit 5. Second printing unit 6 then prints a second color over the first images. Due to fanout of web 2, the images printed by the second printing unit 6 may be laterally adjusted to compensate for the fanout.

A control unit 200, for example one including a microprocessor, can read inputs from sensors 201, 202 for determining a width of web 2. The sensors 201, 202 can be located after or before the blanket cylinders 12, 22. Control unit 200 can then set the proper web width, as will described below.

Figure 2:
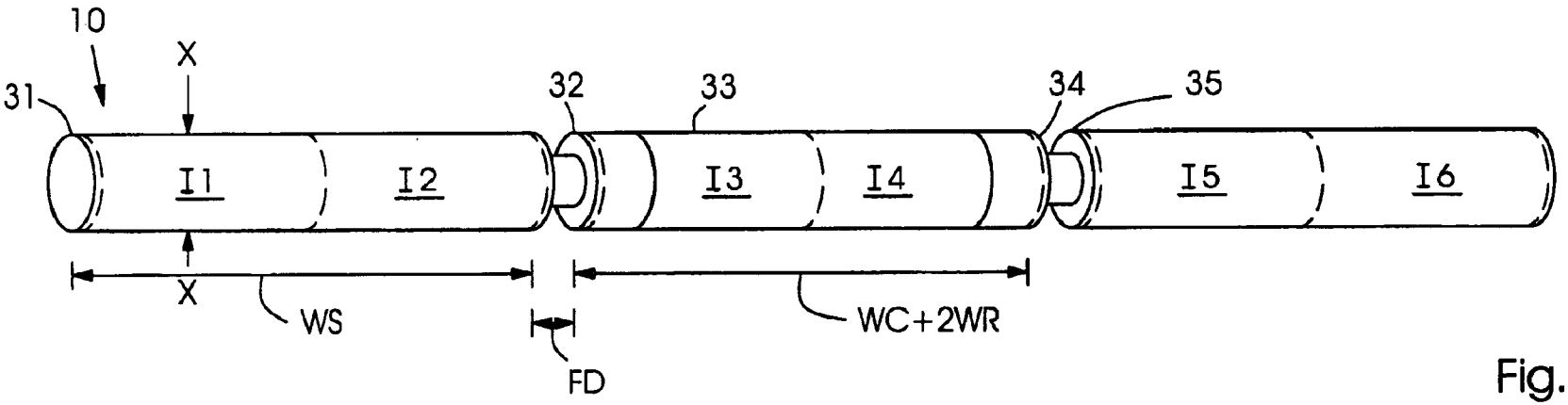
FIG. 2 shows a six-image-wide cylinder of the present invention configured for a full width web.

FIG. 2 shows the cylinder 10 in more detail printing a full width web. Cylinder 10 includes a first shell 31, a first ring 32, a stationary center cylinder section 33, a second ring 34, and a second shell 35. Shells 31 and 35, as well as rings 32 and 34 are axially movable with respect to center cylinder section 33.

Shell 31 has a width WS, rings 32 and 34 have a width WR, and section 33 has a width WC. A distance FD for fanout control is adjustable depending on the desired fanout compensation.

In FIG. 2, a full-width web is printed with six images I1, I2, I3, I4, I5, I6. Shell 31 accommodates images I1 and I2, ring 32 and part of section 33 accommodate image I3, the other part of section 33 and ring 34 accommodate image I4, and shell 35 accommodates images I5, I6. The images preferably are located on flat printing plates which are attached to their respective cylinder parts 31, 32, 33, 34, 35 by lock-up mechanisms.

Figure 4:
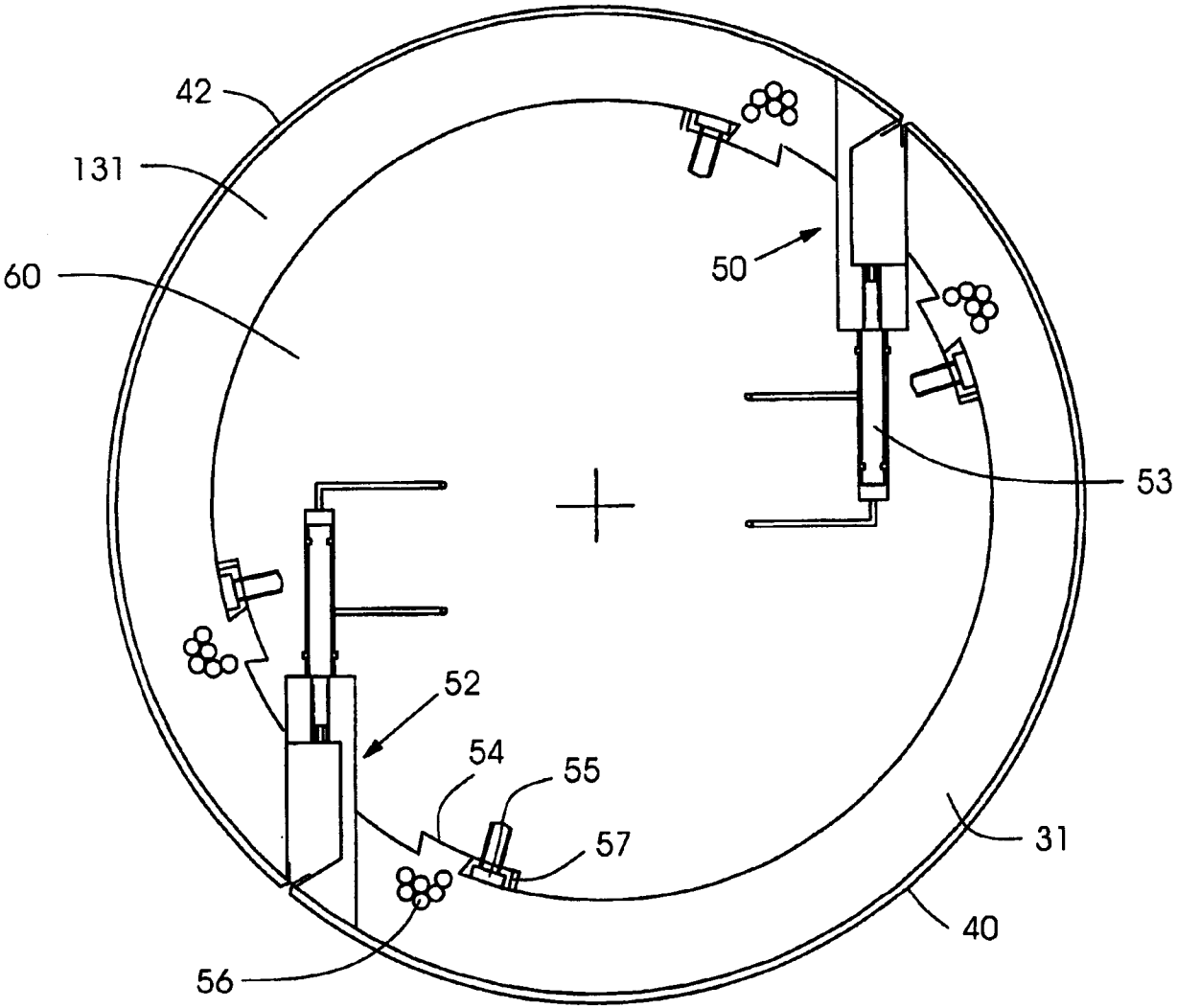
FIG. 4 shows a cross-section of a cylinder with a two-around shell construction and plate lock-ups.

FIG. 4 shows for example a cross section through X—X of FIG. 2. Image 11 is carried on printing plate 40 secured by a lock-up mechanism 50 actuated by a hydraulically-actuated piston 53. Shell 31 can be moved axially via a drive 56, shown schematically in FIG. 4. A dovetail 54 of shell 31 fits in a dovetail slot of a cylinder body 60 of cylinder 10. Cylinder body 60 may be integral with cylindrical section 33 (FIG. 2). A clearance 57 in the dovetail slot may be filled with a lock mechanism 55, which preferably is an axially-extending movable wedge that can fix the shell 31 to cylinder body 60 via friction.

The cylinder 10 maybe two-around, in which case a paired shell 131, second printing plate 42, and second lock-up mechanism 52 are also provided, as shown in FIG. 4. In a one-around press, shell 31 is substantially circular. Presses with more than two images located circumferentially around the cylinder are also possible.

Rings 32, 34 and shell 35 may have a similar construction to shell 31, and may also have corresponding paired rings or shells located circumferentially around the cylinder 10 for a two-around press.

All of the lock-up mechanisms for rings 32, 34, shells 31 and 35 and cylindrical section 33 may be hydraulically actuated. Drive 56 can move both shell 31 and ring 32 axially and independently, and a similar drive may be provided on the opposing side for ring 34 and shell 35.

Figure 5:
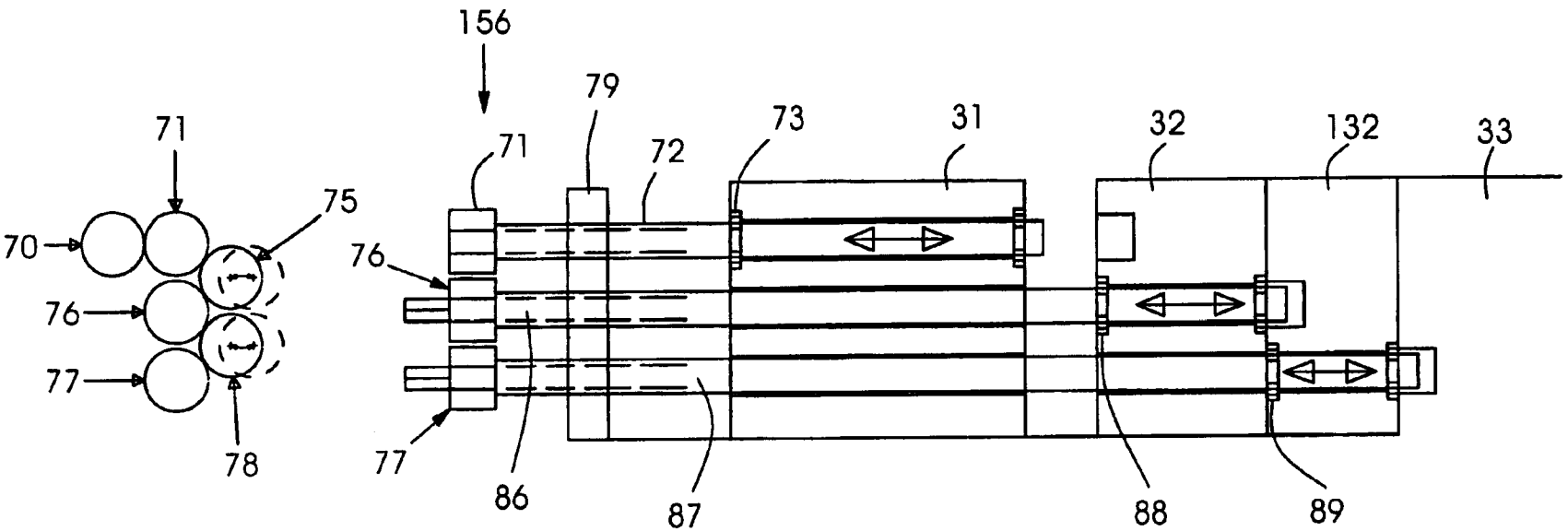
FIG. 5 shows a preferred axial drive mechanism for moving the shell and two intermediate rings with respect to a cylinder section.

For a different extra ring embodiment of the present invention, FIG. 5 shows a drive 156 for shell 31, ring 32 and a second ring 132 in more detail. A motor shaft 70 can rotate a shell drive gear 71, which rotates a shell shaft 72 supported rotatingly in a fixed support 79. The other end of shaft 72 has threading which interacts with threading 73 of shell 31 to cause axial movement of shell 31 upon rotation of shaft 72. Also supported in support 79 are shafts 86 and 87 which interact with threading 88 of ring 32 and threading 89 of ring 132, respectively. Throw-off gear 75 selectively connects gears 71 and 76 to permit shell 31 and ring 32 to move together. Throw-off gear 78 selectively connects gears 76 and 77 to permit rings 32 and 132 to move together. When throw-off gears 75 and 78 are disengaged, gears 76 and 77 are manually adjustable.

Drives 56 and 156 can be controlled by controller 200 (FIG. 1), which can thus set the position of rings 132, 32, 31 as a function of the web width, and also provide for fanout compensation.

For the cylinder 10 shown in FIG. 2, the gears 77, 78 and shaft 87 are unnecessary, since a second ring 132 is not present. Drive 56 thus has may have only two shafts similar to shafts 72 and 86.

For web fanout control of cylinder 10 in FIG. 2, the throw-off gear for drive 56 remains disengaged, as only the shell 31 need to be moved to adjust fanout compensation distance FD.

Figure 3:
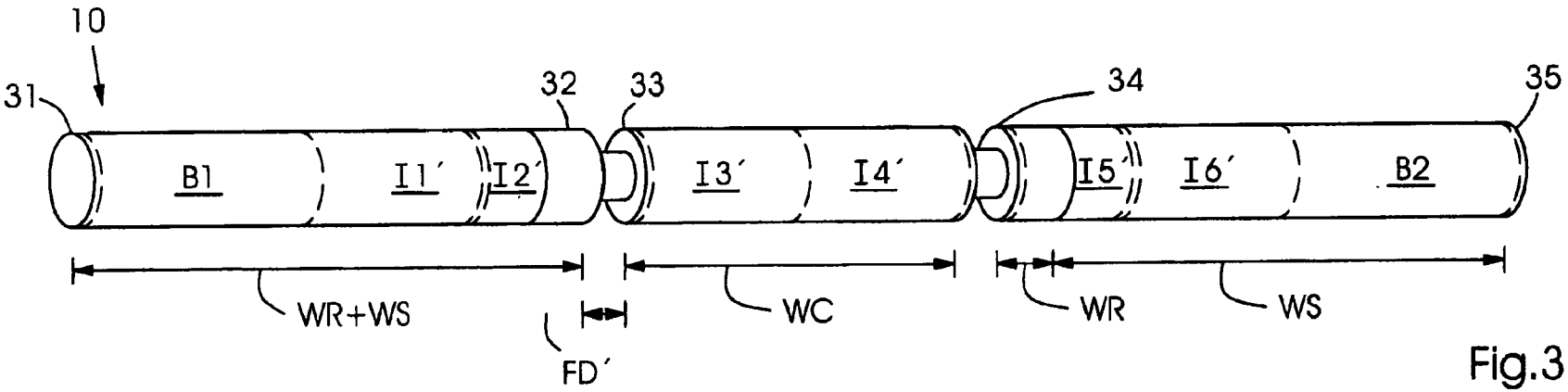
FIG. 3 shows the cylinder of FIG. 2 configured for a narrower web.

If it is desired that a narrower width web be printed with narrower images, the plates or images I1, I2, I3, I4, I5, I6 can be removed. Shell 31 can be moved against ring 32, and the throw-off gear engaged so that ring 32 and shell 31 move together. As shown in FIG. 3, narrower images I1', I2', I3', I4', I5' and I6' can then be placed on the cylinder 10, with image I2' spanning both ring 32 and part of shell 31 and image I4' spanning both ring 34 and part of shell 35. Section B1 of shell 31 and section B2 of shell 35 can remain blank. Since shell 31 and ring 32 move together, drive 56 can compensate for fanout by creating a compensation distance FD'.

Thus a variable width image-carrying cylinder can be provided which also permits proper fanout control.

Instead of the fully mechanical drive 56, it is also possible to move shell 31 mechanically and move the ring 32 axially via an hydraulic mechanism. The shells and rings may be fixed in place axially by a movable wedge in a dovetail joint clearance.

Preferably, the shell width WS is greater than the cylinder section width WC and greater than or equal to section width WC and ring width WR combined. In FIG. 2, WS=WC+2*WR, so that the web width is 3*WS (without fanout). In FIG. 3, the web width is 3*WC (without fanout).

In the embodiment of FIG. 2, it should be noted that a single ring could be provided, while still proving variable width capability. The web 2 however would not necessarily be centered on the section 33 at all widths. Moreover, if the web 2 need not be centered on section 33, the 2-ring embodiment of FIG. 2 can provide another web width equal to 3*(WC+WR).

What is claimed is:

1. A combination of a multiple-image-carrying cylinder, a first printing plate and a second printing plate comprising:

a cylinder section carrying at least part of the first printing plate having a first image to be printed;

a shell axially movable with respect to the cylinder section, the shell carrying at least part of the second printing plate having a second image to be printed; and a ring located between the shell and the cylinder section and axially movable with respect to the shell and the cylinder section, the ring selectively carrying another part of the first printing plate in a first mode of operation when connected to the cylinder section and selectively carrying another part of the second printing plate in a second mode of operation when connected to the shell.

2. The cylinder as recited in claim 1 further comprising a drive moving the shell axially with respect to the ring and cylinder section for the first mode and moving the shell and ring axially with respect to the cylinder section for the second mode.

3. The cylinder as recited in claim 2 wherein the drive includes a throw-off gear.

4. The cylinder as recited in claim 1 further comprising a second axially-movable ring between the first ring and the cylinder section.

5. The cylinder as recited in claim 1 wherein the shell is attached via a dovetail joint to a body of the cylinder, the cylinder section being stationary with respect to the body.

6. The cylinder as recited in claim 1 further comprising a lock-up mechanism for at least part of the second printing plate attached to the shell.

7. The cylinder as recited in claim 1 wherein the shell is on a first side of the cylinder section and further including a second shell on another side of cylinder section.

8. The cylinder as recited in claim 1 further comprising a paired shell circumferentially aside the shell.

9. The cylinder as recited in claim 1 wherein the cylinder carries four further images.

10. The cylinder as recited in claim 1 wherein the cylinder section, shell and ring are provided with axially-extending gaps for the first and second printing plates.

11. The cylinder as recited in claim 1 wherein the shell end the ring define semicircles.

12. The cylinder as recited in claim 1 wherein a ring width is less than a width of the first printing plate.

13. The cylinder as recited in claim 1 wherein a shell width is greater or equal to the sum of a ring width and a cylinder section width.

14. An image-carrying cylinder comprising:

a first axially-movable image-carrying part carrying at least part of a first printing plate with a first image; and a second axially-movable image-carrying part selectively carrying another part of the first printing plate, a drive moving the first and second image-carrying parts axially together or moving the first and second image-carrying parts independently with respect to one another; and a cylinder section for carrying at least part of a second printing plate having a second image, the second part being movable between the cylinder section and the first part, the second part capable of carrying another part of the second printing plate.

15. A web printing press comprising:

a first print unit having a first plate cylinder printing at least two images spaced apart width-wise on a web; and a second print unit, the second print unit including an image-carrying cylinder, the image carrying cylinder including a ring for carrying at least part of a printing plate having an image, the ring being selectively movable in an axial direction between a cylinder section and a cylinder part, at least one of the cylinder section and the cylinder part carrying another part of the printing plate.

16. A method for permitting variable-width images on a cylinder comprising the steps of:

providing a first image to be printed to a first cylinder section;

providing a second image to be printed on a same material as the first image to both a second cylinder section and a third cylinder section connected to the second cylinder section, the second and third cylinder sections being axially movable with respect to the first cylinder section;

removing the first and second images; and providing a third image wider than the first image to both the first cylinder section and the second cylinder section and a fourth image to the third cylinder section, the first and second cylinder sections being connected and axially movable with respect to the thud cylinder section.

17. A method for moving an image-carrying image part comprising the steps of:

moving the part against a cylinder section in a first mode, the part and the cylinder section carrying a first printing plate having a first image; and moving the part against another cylinder part in a second mode, the part and the another part carrying a second printing plate having a second image and being movable axially together with respect to the cylinder section.

18. A method for permitting variable-width images on a cylinder comprising the steps of:

providing a first printing plate having a first image to be printed to a first cylinder section;

providing a second printing plate having a second image to be printed on a same material as the first image to both a second cylinder section and a third cylinder section connected to the second cylinder section, the second and third cylinder sections being axially movable with respect to the first cylinder section;

removing the first and second printing plates; and providing a third printing plate wider than the first printing plate to both the first cylinder section and the second cylinder section and a fourth printing plate to the third cylinder section, the first and second cylinder sections being connected and the third cylinder section being axially movable with respect to the first and second cylinder sections.

19. A multiple-image-carrying cylinder comprising:

a cylinder section having at least part of a first printing plate having a first image to be printed;

a shell axially movable with respect to the cylinder section, the shell having at least part of a second printing plate having a second image to be printed;

a ring located between the shell and the cylinder section and axially movable with respect to the shell and the cylinder section, the ring having another past of the first printing plate when connected to the cylinder section and having another part of the second printing plate when connected to the shell;

a drive moving the shell axially with respect to the ring and cylinder section in a first mode and moving the shell and ring axially with respect to the cylinder section in a second mode, the drive including a throw-off gear.

* * * * *